US009885306B2

(12) United States Patent
Tanaka

(10) Patent No.: US 9,885,306 B2
(45) Date of Patent: Feb. 6, 2018

(54) CONTROL DEVICE FOR INTERNAL COMBUSTION ENGINE

(71) Applicant: TOYOTA JIDOSHA KABUSHIKI KAISHA, Toyota-shi, Aichi-ken (JP)

(72) Inventor: Satoru Tanaka, Yokohama (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 3 days.

(21) Appl. No.: 15/219,574

(22) Filed: Jul. 26, 2016

(65) Prior Publication Data

US 2017/0030284 A1 Feb. 2, 2017

(30) Foreign Application Priority Data

Jul. 28, 2015 (JP) ..... 2015-148796

(51) Int. Cl.
*F02D 41/18* (2006.01)
*F02D 41/24* (2006.01)
(Continued)

(52) U.S. Cl.
CPC ..... *F02D 41/2464* (2013.01); *F02D 41/0007* (2013.01); *F02D 41/1448* (2013.01); *F02D 41/18* (2013.01); *F02D 41/248* (2013.01); *F02D 41/2445* (2013.01); *F02M 35/1038* (2013.01); *F02M 35/10386* (2013.01); *F02D 13/0207* (2013.01); *F02D 41/182* (2013.01);
(Continued)

(58) Field of Classification Search
CPC .... F02D 41/0007; F02D 41/18; F02D 41/182; F02D 41/248; F02D 41/1448; F02D 41/2445; F02D 2041/001; F02D 2200/0402; F02D 2200/0406; F02D 13/0207; F02M 35/1038
See application file for complete search history.

(56) References Cited

U.S. PATENT DOCUMENTS 5,635,634 A * 6/1997 Reuschenbach ..... F01L 1/34 123/90.15
6,467,442 B2 * 10/2002 Russell ..... F01L 1/34 123/295
(Continued)

FOREIGN PATENT DOCUMENTS

JP 2007-211747 A 8/2007
JP 2007-211751 A 8/2007

*Primary Examiner* — Hieu T Vo
*Assistant Examiner* — Arnold Castro
(74) *Attorney, Agent, or Firm* — Andrews Kurth Kenyon LLP

(57) ABSTRACT

Respective learned values of four parameters, that are an intake valve working angle deviation amount, an exhaust valve working angle deviation amount, an intake valve timing deviation amount and an exhaust pressure loss deviation amount, are calculated based on learned values of an intake valve flow rate error that are obtained under at least four different operating conditions. A correction amount with respect to an intake valve flow rate that is calculated with an intake valve model equation is calculated based on respective learned values of the four parameters using an intake valve flow rate error model equation in which coefficients are represented by functions of state quantities of an engine that include an engine speed and an intake pipe pressure.

3 Claims, 8 Drawing Sheets

(51) Int. Cl.

| | |
|---|---|
| ***F02D 45/00*** | (2006.01) |
| ***F02D 41/00*** | (2006.01) |
| ***F02D 41/14*** | (2006.01) |
| ***F02M 35/10*** | (2006.01) |
| *F02D 13/02* | (2006.01) |

(52) U.S. Cl.
CPC ..... *F02D 2041/001* (2013.01); *F02D 2200/0402* (2013.01); *F02D 2200/0406* (2013.01)

(56) References Cited

U.S. PATENT DOCUMENTS 7,398,762 B2 * 7/2008 Russell ..... F02D 13/02 123/434
9,752,524 B2 * 9/2017 Hagner ..... F02D 41/1497
2001/0003979 A1 * 6/2001 Oki ..... F02D 41/0032 123/520
2002/0062687 A1 * 5/2002 Reed ..... F01L 1/34 73/114.01
2002/0133286 A1 * 9/2002 Kolmanovsky ..... F02D 41/1401 701/104
2005/0000489 A1 * 1/2005 Fuwa ..... F02D 13/0211 123/345
2006/0037596 A1 * 2/2006 Fuwa ..... F02D 41/18 123/681
2006/0081217 A1 * 4/2006 Fuwa ..... F01L 1/34 123/350
2008/0072862 A1 * 3/2008 Turner ..... F01L 1/143 123/184.42
2008/0167785 A1 * 7/2008 Miyakoshi ..... F02D 13/0223 701/102
2009/0211548 A1 * 8/2009 Takahashi ..... F01L 13/0021 123/90.16
2014/0034026 A1 * 2/2014 Katsumata ..... F02D 41/0007 123/559.1
2014/0326213 A1 * 11/2014 Katsumata ..... F02D 41/107 123/399
2015/0275782 A1 * 10/2015 Moriguchi ..... F02D 41/18 60/605.1
2017/0030284 A1 * 2/2017 Tanaka ..... F02D 41/0007
2017/0082075 A1 * 3/2017 Takezoe ..... F02M 35/10373

* cited by examiner

| NO. | PHYSICAL CHANGE AMOUNTS THAT CAN BE SUMMARIZED | MECHANICAL FACTORS FOR INTAKE VALVE FLOW RATE ERROR |
|---|---|---|
| 1 | INTAKE VALVE WORKING ANGLE DEVIATION AMOUNT | INTAKE VALVE LIFT CURVE VARIATIONS (ROCKER ARM WEAR, CAMSHAFT WEAR, VALVE SPRING FATIGUE, etc.), ADHESION OF INTAKE VALVE DEPOSITS |
| 2 | EXHAUST VALVE WORKING ANGLE DEVIATION AMOUNT | EXHAUST VALVE LIFT CURVE VARIATIONS (ROCKER ARM WEAR, CAMSHAFT WEAR, VALVE SPRING FATIGUE, etc.), ADHESION OF EXHAUST VALVE DEPOSITS |
| 3 | INTAKE VALVE TIMING DEVIATION AMOUNT | TIMING CHAIN DETERIORATION, SPROCKET DETERIORATION |
| 4 | EXHAUST PRESSURE LOSS DEVIATION AMOUNT | TURBINE CHARACTERISTICS VARIATIONS, CATALYST CLOGGING, ADHESION OF WGV DEPOSITS, WGV ROD DEFORMATION |

Fig. 3

THIRD CONDITION: MEDIUM ENGINE SPEED, HIGH ENGINE LOAD, LARGE OL

FOURTH CONDITION: HIGH ENGINE SPEED, HIGH ENGINE LOAD

CONTROL DEVICE FOR INTERNAL COMBUSTION ENGINE

CROSS-REFERENCE TO RELATED APPLICATION

The present application claims priority to Japanese Patent Application No. 2015-148796 filed on Jul. 28, 2015, which is incorporated herein by reference in its entirety.

BACKGROUND

Field of the Disclosure

The present disclosure relates to a control device for an internal combustion engine that estimates an intake valve flow rate based on an estimated value or a measured value of an intake pipe pressure using an intake valve model equation in which an intake valve flow rate is represented by a linear expression that adopts an intake pipe pressure as a variable.

Background Art

As described in JP2007-211747A, an intake valve flow rate that is a flow rate of air that passes through an intake valve and enters a cylinder can be represented by a linear expression that adopts an intake pipe pressure that is a pressure in a space from a throttle to the intake valve as a variable. This linear expression is referred to as an "intake valve model equation" (model calculation equation of an intake valve model). Coefficients (specifically, a slope and an intercept) of the intake valve model equation are determined by adaptation for respective operating conditions that are assumed. However, in some cases, due to manufacturing errors in components of an internal combustion engine or to aged deterioration thereof, a deviation can arise between a relation between an intake pipe pressure and an intake valve flow rate that is assumed in the intake valve model equation and the actual relation therebetween. Such a deviation lowers the estimation accuracy for the intake valve flow rate.

In JP2007-211747A, a technique is disclosed for correcting coefficients of the intake valve model equation based on a comparison between measured values of operation parameters that are measured during operation of an internal combustion engine and estimated values of operation parameters that are calculated using the intake valve model equation. According to the aforementioned technique, correction of coefficients of the intake valve model equation is performed in operating region units that are defined based on the opening timing of the intake valve and the engine speed, and the corrected coefficients are stored as learned values for each operating region. If the coefficients of the intake valve model equation can be made appropriate, a decrease in the estimation accuracy with respect to the intake valve flow rate due to manufacturing errors in components of an internal combustion engine or to aged deterioration thereof can be suppressed.

JP2007-211751A also shows the state of the art at the date of filing of this application.

SUMMARY

According to the technique described in JP2007-211747A, with respect to operating conditions for which the selection frequency is high, because appropriate adjustment of coefficients of an intake valve model equation by learning is frequently performed, a decrease in the estimation accuracy with respect to the intake valve flow rate is suppressed. However, with respect to operating conditions that are temporarily selected during transient operation, because the coefficients of the intake valve model equation are not subjected to much adjustment, a decrease in the estimation accuracy with respect to the intake valve flow rate is liable to occur due to aged deterioration of components of the internal combustion engine. That is, with the technique described in JP2007-211747A, there is the problem that an error depending on the selection frequency of the operating conditions arises in the accuracy of estimating the intake valve flow rate using the intake valve model equation.

An object of the present disclosure is to provide a control device that can suppress a decrease in the estimation accuracy with respect to an intake valve flow rate that is estimated using an intake valve model equation, under a wide range of operating conditions which include not only operating conditions for which the selection frequency is high, but also include operating conditions for which the selection frequency is low.

A control device for an internal combustion engine according to an embodiment of the present invention is a control device that is applied to an internal combustion engine including an air flow sensor and an intake pipe pressure sensor, and that is configured to estimate an intake valve flow rate based on an estimated value or a measured value of an intake pipe pressure using an intake valve model equation in which an intake valve flow rate is represented by a linear expression that adopts an intake pipe pressure as a variable. As means for suppressing a decrease in estimation accuracy with respect to an intake valve flow rate that is estimated using the intake valve model equation, this embodiment includes an error learning unit, a parameter learned value calculating unit and a correction amount calculating unit.

The error learning unit is configured to learn, under at least four different operating conditions, an intake valve flow rate error that is an error between a first intake valve flow rate that is obtained by inputting a measured value of an intake pipe pressure that is measured by the intake pipe pressure sensor into the intake valve model equation and a second intake valve flow rate that is calculated based on a measured value of a fresh air flow rate that is measured by the air flow sensor. The first intake valve flow rate and the second intake valve flow rate should approximately match unless a deviation arises between the relation between the intake pipe pressure and the intake valve flow rate that is defined by the intake valve model equation and the actual relation therebetween that is due to the influence of manufacturing errors or aged deterioration of components of the internal combustion engine. If an error arises between the aforementioned two relations, it is considered that a manufacturing error or aged deterioration is present in some component or other of the internal combustion engine (particularly, a component that affects the intake valve flow rate).

As the result of extensive studies conducted by the inventor of the present application it was found that the above described intake valve flow rate error is caused by a deviation from a design value of the following four physical quantities: an intake valve working angle, an exhaust valve working angle, an intake valve timing and an exhaust pressure loss. A manufacturing error or aged deterioration of a component of an internal combustion engine that affects the relation between an intake pipe pressure and an intake valve flow rate results in a deviation from a design value of any one of these four physical quantities.

Further, as a result of extensive studies conducted by the inventor of the present application it was found that, an amount of deviation relative to a design value of the intake valve working angle, an amount of deviation relative to a design value of the exhaust valve working angle, an amount of deviation relative to a design value of the intake valve timing, and an amount of deviation relative to a design value of the exhaust pressure loss are independent from each other with respect to the respective influences thereof on an intake valve flow rate error. This means that an intake valve flow rate error can be represented by a polynomial expression that adopts the amounts of deviation from the respective design values of these four physical quantities as parameters.

More specifically, the polynomial expression includes: a first order term of a first parameter that is an amount of deviation relative to a design value of an intake valve working angle, a first order term of a second parameter that is an amount of deviation relative to a design value of an exhaust valve working angle, a first order term of a third parameter that is an amount of deviation relative to a design value of an intake valve timing, and a first order term of a fourth parameter that is an amount of deviation relative to a design value of an exhaust pressure loss. Further, it was also found that the respective influences of the first to fourth parameters on the intake valve flow rate error depend on state quantities of the internal combustion engine including at least the engine speed and the intake pipe pressure. Hence, coefficients of the respective terms in the above described polynomial expression are represented by a function of state quantities of the internal combustion engine including at least the engine speed and intake pipe pressure. Hereunder, an equation in which an intake valve flow rate error is represented by the above described polynomial expression is referred to as an "intake valve flow rate error model equation".

The parameter learned value calculating unit is configured to use the intake valve flow rate error model equation to calculate respective learned values of the first to fourth parameters based on learned values of an intake valve flow rate error under at least four different operating conditions that are learned by the error learning unit, and values of coefficients of respective terms under operating conditions in which learning of an intake valve flow rate error is performed. Specifically, for each operating condition under which learning is performed, at least four different equations are established by substituting a learned value of the intake valve flow rate error and values of coefficients of each term into the intake valve flow rate error model equation. If there are at least four different equations, values of four parameters that are unknown quantities can be calculated by the least squares method. That is, performing learning of an intake valve flow rate error under at least four different operating conditions is a necessary condition to identify the values of the first to fourth parameters.

The correction amount calculating unit is configured to calculate a correction amount with respect to an intake valve flow rate that is calculated with the intake valve model equation, by substituting respective learned values of the first to fourth parameters that are calculated by the parameter learned value calculating unit into the intake valve flow rate error model equation. Since the coefficients of the respective terms of the intake valve flow rate error model equation are functions of state quantities of the internal combustion engine including the engine speed and the intake pipe pressure, the values thereof are changed according to the operating condition. By this means, under an operating condition other than an operating condition under which learning of an intake valve flow rate error is performed, for example, an operating condition for which the selection frequency is low, such as an operating condition that is only selected during transient operation, an appropriate correction amount that is in accordance with the operating condition can be obtained, and hence a decrease in the estimation accuracy with respect to the intake valve flow rate can be suppressed under a wide range of operating conditions.

An internal combustion engine to which an embodiment of the present control device is applied may include a turbocharger, an intake-side variable valve gear that makes a working angle and a valve timing of an intake valve variable, and an exhaust-side variable valve gear that makes a working angle and a valve timing of an exhaust valve variable. Further, an embodiment of the present control device may be configured to, at a time of acceleration, actuate the intake-side variable valve gear and the exhaust-side variable valve gear so as to expand an overlap between the intake valve and the exhaust valve.

In this embodiment, preferably, the parameter learned value calculating unit is configured to learn an intake valve flow rate error under at least the following four operating conditions. A first operating condition is an operating condition under which steady-state running is being performed. A second operating condition is an operating condition at an early stage of acceleration under which the engine speed is lower and the engine load is higher than under the first operating condition, and under which an overlap is being expanded more than under the first operating condition. A third operating condition is an operating condition at a middle stage of acceleration in which the engine speed is higher than under the second operating condition, and the overlap is being expanded in a similar manner to under the second operating condition. A fourth operating condition is an operating condition at a final stage of acceleration in which the engine speed is higher than under the third operating condition, and the overlap is being contracted relative to the third operating condition. According to these operating conditions, there is a difference between the parameters with respect to the magnitude of an influence of each parameter on an intake valve flow rate error, and furthermore, a parameter that exerts a large influence differs for each of the operating conditions. Consequently, by performing parameter learning using intake valve flow rate errors that are learned under these operating conditions, errors included in learned values of the respective parameters can be reduced.

Embodiments of the present control device may also include a fuel injection valve actuation unit that is configured to calculate an in-cylinder air amount based on an intake valve flow rate that is calculated with an intake valve model equation and is corrected by a correction amount that is calculated by the correction amount calculating unit, and actuating a fuel injection valve according to a fuel injection amount that is calculated based on the in-cylinder air amount. If the intake valve flow rate can be estimated with high accuracy, the in-cylinder air amount can also be estimated with high accuracy, and consequently the fuel injection amount can be controlled to an appropriate amount (for example, an amount that can cause the actual air-fuel ratio to match a target air-fuel ratio).

As described above, according to embodiments of the control device for an internal combustion engine of the present disclosure, under a wide range of operating conditions that include operating conditions for which a selection frequency is low and not only operating conditions for which a selection frequency is high, a decrease in the estimation accuracy of an intake valve flow rate that is estimated using an intake valve model equation can be suppressed.

BRIEF DESCRIPTION OF THE DRAWINGS

FIG. 2 is a block diagram illustrating a structure for estimating an intake valve flow rate that an ECU is equipped with;

FIG. 3 is a table that associates mechanical factors that produce an error in an intake valve flow rate and four parameters;

DETAILED DESCRIPTION OF A PREFERRED EMBODIMENT

An embodiment of the present invention is described hereunder with reference to the accompanying drawings. However, it is to be understood that even when the number, quantity, amount, range or other numerical attribute of an element is mentioned in the following description of the embodiment, the claimed invention is not limited to the mentioned numerical attribute unless expressly stated or theoretically defined. Further, descriptions of, e.g., structures or steps in conjunction with the following embodiment are not necessarily essential to the claimed invention unless expressly stated or theoretically defined.

Figure 1:
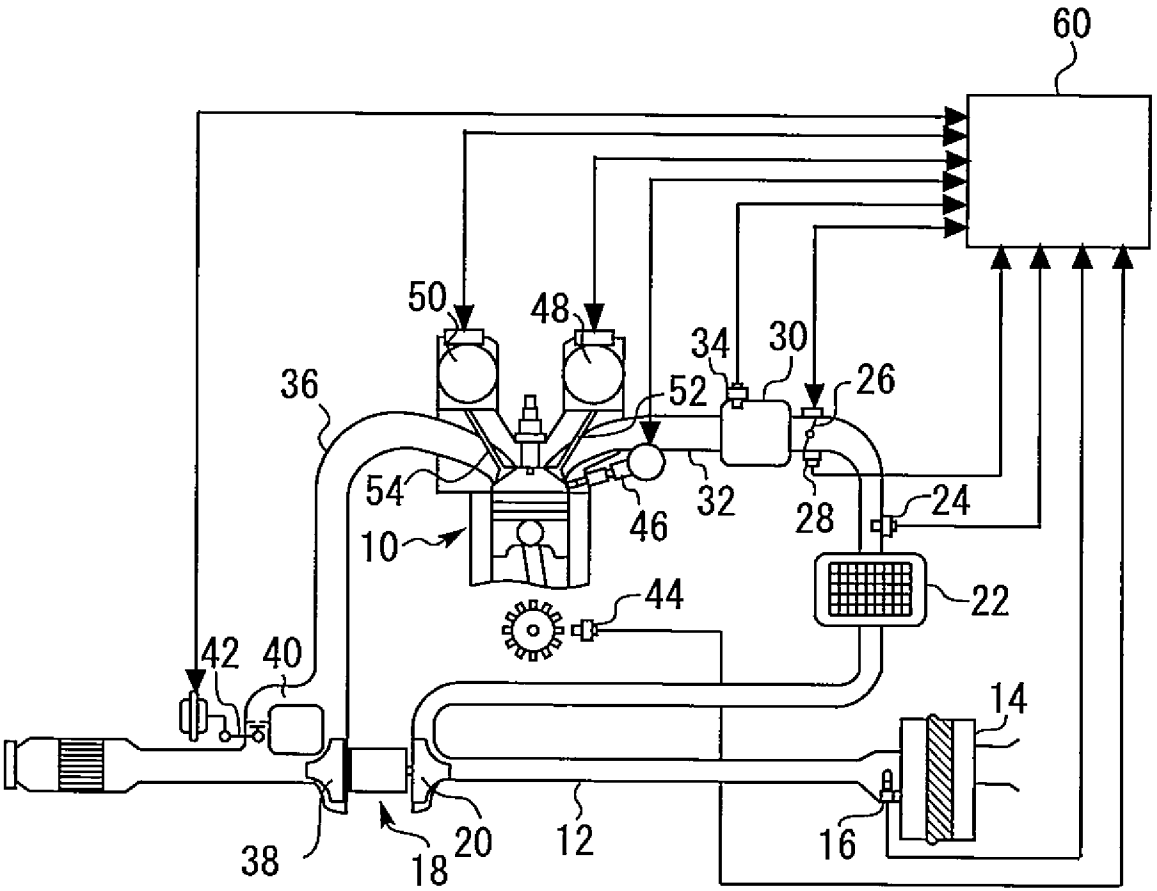
FIG. 1 is a schematic diagram illustrating the configuration of an internal combustion engine that is controlled by a control device of an embodiment of the present disclosure.

FIG. 1 is a schematic diagram illustrating the configuration of an internal combustion engine that is controlled by a control device of the present embodiment. An internal combustion engine (hereunder, referred to as simply "engine") 10 according to the present embodiment is configured as a spark-ignition engine that is mounted in a vehicle. However, the number of cylinders and the cylinder arrangement of the engine 10 are not particularly limited.

In a cylinder head of the engine 10 are provided an intake valve 52 and an exhaust valve 54 that are driven by motive power taken from a crankshaft, and a fuel injection valve (in-cylinder injection valve) 46 that injects fuel directly into a cylinder. The engine 10 also includes an intake-side variable valve gear 48 that makes valve opening characteristics of the intake valve 52 variable, and an exhaust-side variable valve gear 50 that makes valve opening characteristics of the exhaust valve 54 variable. A known valve gear that makes at least a valve timing and a working angle variable can be applied as the variable valve gears 48 and 50.

The engine 10 has a turbocharger 18. A compressor 20 of the turbocharger 18 is provided in an intake passage 12 of the engine 10. A turbine 38 of the turbocharger 18 is provided in an exhaust passage 36 of the engine 10. An intercooler 22 for cooling compressed air is provided downstream relative to the compressor 20 in the intake passage 12. A bypass passage 40 that bypasses the turbine 38 is provided in the exhaust passage 36. A waste gate valve 42 is arranged in the bypass passage 40.

The intake passage 12 is connected through a surge tank 30 to an intake manifold (intake pipe) 32. An electronically controlled throttle 26 is provided in the vicinity of the surge tank 30 in the intake passage 12. A throttle opening degree sensor 28 is provided in the throttle 26 to measure the opening degree thereof. An air cleaner 14 is provided at a front end of the intake passage 12. An air flow sensor 16 for measuring a flow rate of air (fresh air) is installed in the vicinity of the air cleaner 14 in the intake passage 12. A turbocharging pressure sensor 24 for measuring a turbocharging pressure is installed between the intercooler 22 and the throttle 26 in the intake passage 12. An intake pipe pressure sensor 34 for measuring an intake pipe pressure is installed in the surge tank 30.

The control device of the present embodiment is realized as one portion of the functions of an ECU (electronic control unit) 60 that controls the engine 10. The ECU 60 includes at least an input/output interface, a ROM, a RAM and a CPU. The input/output interface takes in sensor signals from various sensors installed in the engine 10 and a vehicle in which the engine 10 is mounted, and also outputs actuating signals to actuators that the engine 10 includes. Sensors that are connected to the ECU 60 include, in addition to the aforementioned sensors, a crank angle sensor 44 for measuring the engine speed. Various programs and various kinds of data including maps that are used for controlling the engine 10 are stored in the ROM. The ECU 60 realizes various functions as a result of the CPU reading out and executing programs from the ROM.

The ECU 60 as the control device has a function that estimates an air amount that is filled into cylinders (hereunder, referred to as "in-cylinder air amount") of the engine 10 when the intake valve 52 is closed, and a function that calculates a required fuel injection amount based on the estimated in-cylinder air amount and a target air-fuel ratio, and actuates the fuel injection valve 46 in accordance with the calculated fuel injection amount. The latter function is a function as "fuel injection valve actuation unit" that is described in the claims.

The ECU 60 as the control device uses an air model for estimating the in-cylinder air amount. Air models themselves are already known. An air model for a naturally aspirated engine is disclosed, for example, in Japanese Patent Laid-Open No. 2007-211747 and Japanese Patent Laid-Open No. 2004-211590. An air model for a supercharged engine is disclosed in International Publication No. WO 2013/084318 and International Publication No. WO 2012/143997. An air model used in the present embodiment is an air model for a turbocharged engine. A feature of the ECU 60 as the control device is in a structure that relates to estimation of an intake valve flow rate, and that feature relates to an intake valve model among a plurality of element models constituting the air model.

Figure 2:
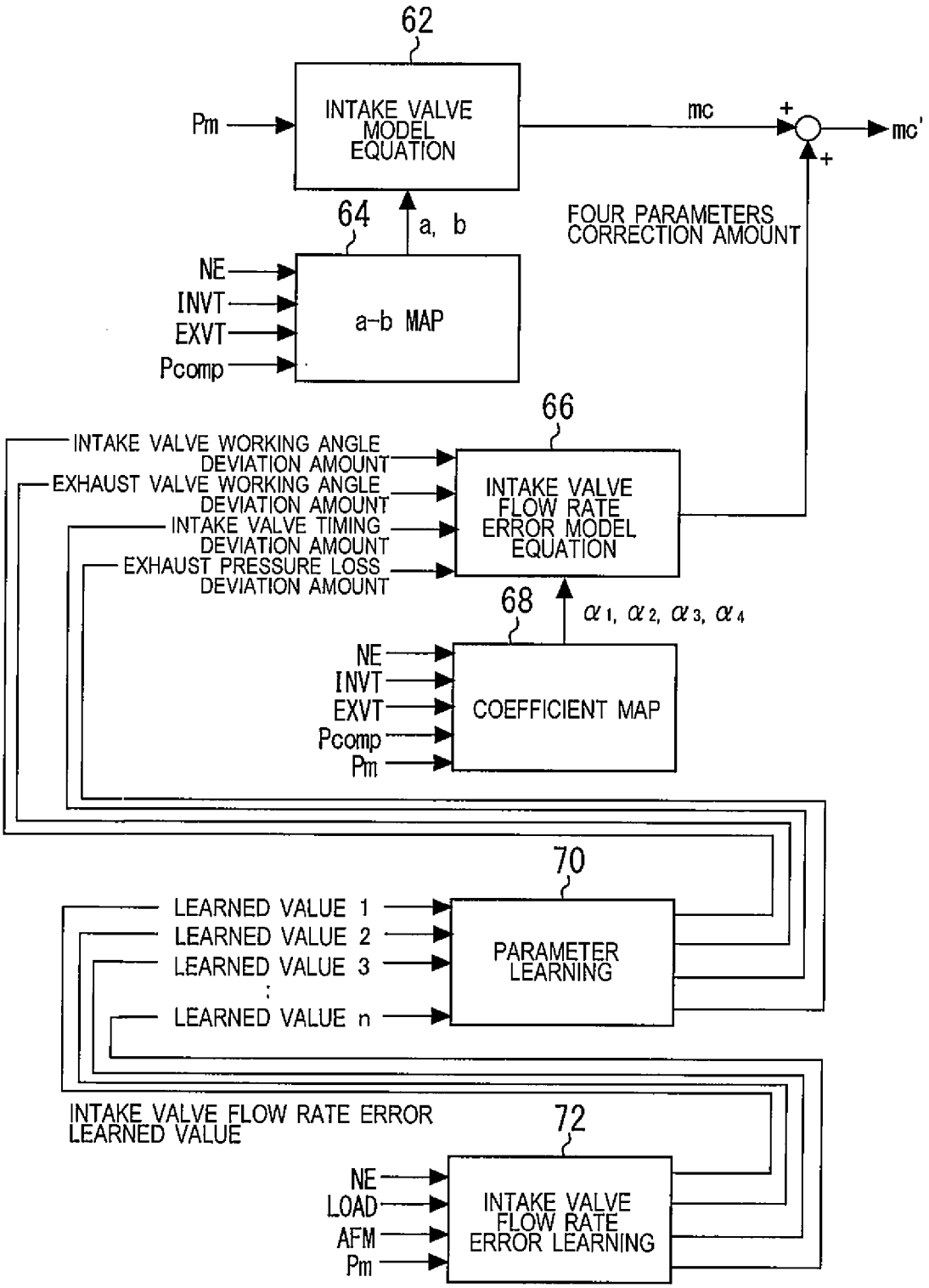

FIG. 2 is a block diagram illustrating a structure for estimating the intake valve flow rate that the ECU 60 is equipped with. The ECU 60 includes, as elements for estimating the intake valve flow rate, a first arithmetic unit 62 that stores an intake valve model equation, a second arithmetic unit 64 that stores a map for determining coefficients of the intake valve model equation, a third arithmetic unit 66 that stores an intake valve flow rate error model equation, a fourth arithmetic unit 68 that stores a map for determining coefficients of the intake valve flow rate error model equation, a fifth arithmetic unit 70 that learns four parameters that are described later, and a sixth arithmetic unit 72 that learns an intake valve flow rate error. Note that, the configuration shown in FIG. 2 is a configuration that is virtually realized by the CPU operating in accordance with a program stored in the ROM of the ECU 60.

The first arithmetic unit 62 is configured to calculate an intake valve flow rate mc based on an intake pipe pressure Pm in accordance with an intake valve model equation that is represented by the following equation (1). In the intake valve model equation, the intake valve flow rate mc is represented by a linear expression that adopts the intake pipe pressure Pm as a variable. The intake pipe pressure Pm that is input to the first arithmetic unit 62 is an estimated value of the intake pipe pressure that is calculated by means of a throttle model and an intake pipe model. A method disclosed in the aforementioned known literature can be cited as a method for estimating an intake pipe pressure using these models, and hence a description thereof is omitted in the present description.

$$mc=a\times Pm+b \qquad \text{equation (1)}$$

The second arithmetic unit 64 is configured to determine a slope "a" and an intercept "b" that are coefficients of the intake valve model equation based on an engine speed NE, an intake valve timing INVT, an exhaust valve timing EXVT and a turbocharging pressure Pcomp, using a stored a-b map. The engine speed NE and the turbocharging pressure Pcomp are measured values that are measured by a sensor, and the intake valve timing INVT and the exhaust valve timing EXVT are set values. In the a-b map, adaptive values of the coefficients a and b that are obtained by subjecting the engine 10 to a bench test are stored for each engine speed NE, each intake valve timing INVT, each exhaust valve timing EXVT and each turbocharging pressure Pcomp.

The aforementioned a-b map can be prepared with high accuracy by taking an appropriate number of man-hours to perform the adaptation work. However, no matter how much the accuracy of the a-b map is raised, an error will arise between an intake valve flow rate that is calculated with the intake valve model equation and an actual value due to manufacturing errors or aged deterioration of engine components. As a method for maintaining the accuracy of estimating an intake valve flow rate, it is conceivable to identify a factor that generates an error and convert the factor into a numerical value, and then correct the error based on the numerical value. However, because there are a variety of mechanical factors that generate an error in an intake valve flow rate, it is difficult to ascertain all such errors, and conversion of such errors into numerical values is also difficult.

Therefore, the inventor of the present application conducted extensive studies regarding a method that can precisely determine the degree of an error in an intake valve flow rate even without identifying mechanical factors, and can compensate for the determined error. As a result of the extensive studies conducted by the inventor of the present application, although various mechanical factors can be mentioned as factors that generate an error in an intake valve flow rate, it was revealed that the physical change amounts caused by such mechanical factors are summarized into the following four physical change amounts. The four physical change amounts are: an amount of deviation relative to a design value of the intake valve working angle (hereunder, referred to as "intake valve working angle deviation amount"), an amount of deviation relative to a design value of the exhaust valve working angle (hereunder, referred to as "exhaust valve working angle deviation amount"), an amount of deviation relative to a design value of the intake valve timing (opening timing) (hereunder, referred to as "intake valve timing deviation amount"), and an amount of deviation relative to a design value of the exhaust pressure loss (hereunder, referred to as "exhaust pressure loss deviation amount").

The fact that physical change amounts relating to an error in the intake valve flow rate can be summarized into the above described four physical change amounts can be explained with reasons as described hereunder.

First, a total in-cylinder gas amount Mc can be represented by the following equation (2) in which $Pc_{IVC}$ denotes an in-cylinder pressure at a closing timing (IVC) of the intake valve, $Vc_{IVC}$ denotes an in-cylinder volume at the closing timing of the intake valve, and $Tc_{IVC}$ denotes the in-cylinder temperature at the closing timing of the intake valve.

$$Mc = \frac{Pc_{IVC} \times Vc_{IVC}}{R \times Tc_{IVC}} \qquad \text{equation (2)}$$

When the aforementioned total in-cylinder gas amount Mc is separated into a fresh air amount Mair and an internal EGR amount Megr, the fresh air amount Mair that has a correlation with the intake valve flow rate can be represented by the following equation (3).

$$Mair = \frac{Pc_{IVC} \times Vc_{IVC}}{R \times Tc_{IVC}} - Megr \qquad \text{equation (3)}$$

Based on equation (3) it is found that factors that directly change the fresh air amount Mair are a change in the closing timing IVC of the intake valve and a change in the internal EGR amount Megr. A change in the closing timing IVC of the intake valve can be further separated into a change in the intake valve working angle and a change in the intake valve timing. Thus, it can be explained that the intake valve working angle deviation amount and the intake valve timing deviation amount are physical change amounts that determine an error in the intake valve flow rate.

On the other hand, a change in the internal EGR amount Megr can be further separated into a change in a blow-back period of EGR gas and a change in a flow rate of EGR gas that is blown back. Because a blow-back period of EGR gas depends on the working angle of the exhaust valve, and a flow rate of EGR gas that is blown back depends on the exhaust pressure loss, ultimately a change in the internal EGR amount Megr can be broken down into a change in the exhaust valve working angle and a change in the exhaust pressure loss. Thus, it can be explained that the exhaust valve working angle deviation amount and the exhaust pressure loss deviation amount are physical change amounts that determine an error in the intake valve flow rate.

In the table shown in FIG. 3, mechanical factors that generate an error in the intake valve flow rate are associated with the above described four physical change amounts. First, variations in a lift curve of the intake valve that arise for reasons such as wear of a rocker arm, wear of a cam and fatigue of a valve spring relate to the intake valve working angle deviation amount. The adhesion of deposits to the intake valve also relate to the intake valve working angle deviation amount. Similarly, variations in the lift curve of the exhaust valve and adhesion of deposits to the exhaust valve relate to the exhaust valve working angle deviation amount. Deterioration of a timing chain and sprocket relate to the intake valve timing deviation amount. Further, variations in turbine characteristics, clogging of a catalyst, a deformation in the rod of the waste gate valve, and adhesion of deposits to the waste gate valve relate to the exhaust pressure loss deviation amount.

With respect to mechanical factors relating to the intake valve working angle deviation amount, by performing calculations using a detailed model of the engine 10, the inventor of the present application checked whether or not an intake valve flow rate error changes where values of the same factors were changed while keeping the intake valve working angle deviation amount the same. As a result, it was found that, under all operating conditions, if the intake valve working angle deviation amount is the same, regardless of what the mechanical factors are, the intake valve flow rate error is constant. Further, it was confirmed the same situation as that of the intake valve working angle deviation amount also applied with respect to the exhaust valve working angle deviation amount, the intake valve timing deviation amount and the exhaust pressure loss deviation amount. That is, as a result of extensive studies conducted by the inventor of the present application it was found that, as long as the above described four physical change amounts can be identified, even if the mechanical factors are unknown, the degree of an error in the intake valve flow rate can be accurately determined.

Next, by simulation by means of a bench test and a detailed model, the inventor of the present application examined the relation between the above described four physical change amounts and the intake valve flow rate error. As a result, it was found that the above described four physical change amounts are mutually independent with regard to the respective influences thereof on an intake valve flow rate error, and the intake valve flow rate error can be represented by a polynomial expression that adopts the above four physical change amounts as parameters. The polynomial expression is an intake valve flow rate error model equation that is stored in the third arithmetic unit 66, and a map in which coefficients of each term of the polynomial expression are held is stored in the fourth arithmetic unit 68.

The third arithmetic unit 66 is configured to, in accordance with an intake valve flow rate error model equation that is represented by the following equation (4), calculate a correction amount with respect to the intake valve flow rate mc that is calculated with the intake valve model equation, by means of four parameters, that is, an intake valve working angle deviation amount as a first parameter, an exhaust valve working angle deviation amount as a second parameter, an intake valve timing deviation amount as a third parameter, and an exhaust pressure loss deviation amount as a fourth parameter. Hereunder, these parameters are referred to collectively as "four parameters", and a correction amount that is calculated using the four parameters is referred to as "four parameters correction amount". The four parameters correction amount is a correction amount for correcting by feed-forward correction an error included in the intake valve flow rate mc that is calculated with the intake valve model equation. Note that, the four parameters that are input to the third arithmetic unit 66 are learned values that are learned based on actual values of the intake valve flow rate error by a method described later.

$$\begin{aligned}\text{Four parameters correction amount} = {} & \text{Intake valve working angle deviation amount} \times \alpha_1 + \\ & \text{Exhaust valve working angle deviation amount} \times \alpha_2 + \\ & \text{Intake valve timing deviation amount} \times \alpha_3 + \\ & \text{Exhaust pressure loss deviation amount} \times \alpha_4\end{aligned} \quad \text{equation (4)}$$

The inventor of the present application also found as the result of extensive studies that the influence of the four parameters on the intake valve flow rate error depends on specific state quantities of the engine 10. The specific state quantities are the engine speed, the intake valve timing, the exhaust valve timing, the turbocharging pressure and the intake pipe pressure. Therefore, the coefficients $\alpha_1$, $\alpha_2$, $\alpha_3$ and $\alpha_4$ of the respective terms in the intake valve flow rate error model equation are not fixed values, but are adopted as functions of these state quantities.

In the coefficient map that is stored in the fourth arithmetic unit 68, adaptive values of coefficients $\alpha_1$, $\alpha_2$, $\alpha_3$ and $\alpha_4$ obtained in the bench test of the engine 10 are stored for each engine speed NE, each intake valve timing INVT, each exhaust valve timing EXVT, each turbocharging pressure Pcomp and each intake pipe pressure Pm. The fourth arithmetic unit 68 is configured to use the coefficient map to determine coefficients $\alpha_1$, $\alpha_2$, $\alpha_3$ and $\alpha_4$ of each term of the intake valve flow rate error model equation based on the engine speed NE, the intake valve timing INVT, the exhaust valve timing EXVT, the turbocharging pressure Pcomp and the intake pipe pressure Pm. Note that, the engine speed NE, the turbocharging pressure Pcomp and the intake pipe pressure Pm are measured values that are measured by a sensor, and the intake valve timing INVT and the exhaust valve timing EXVT are set values.

The ECU 60 obtains a corrected intake valve flow rate mc' by adding a four parameters correction amount calculated by the third arithmetic unit 66 to an intake valve flow rate mc calculated by the first arithmetic unit 62. The ECU 60 then calculates an in-cylinder air amount based on the corrected intake valve flow rate mc'. Specifically, for example, where the engine 10 is a four-stroke, inline four-cylinder engine, a time period required for the crankshaft to rotate by 180° is multiplied by the corrected intake valve flow rate mc'. By this means, an air amount (fresh air amount) per cycle that passes through the intake valve and enters the cylinders, that is, an in-cylinder air amount, can be calculated.

Next, a method for learning the four parameters will be described. Learning of the four parameters is performed based on learned values of the intake valve flow rate error that are learned by the sixth arithmetic unit 72. The sixth arithmetic unit 72 measures the intake pipe pressure Pm by means of the intake pipe pressure sensor 34, and obtains a first intake valve flow rate by inputting the intake pipe pressure Pm into the intake valve model equation. Further, a fresh air flow rate AFM is measured by the air flow sensor 16 under the same operating conditions, and a second intake valve flow rate is calculated based on the fresh air flow rate AFM. When the engine 10 is in a steady state, the second intake valve flow rate can be regarded as being equal to the fresh air flow rate AFM. Although the aforementioned various mechanical factors such as manufacturing errors or aged deterioration of the engine 10 influence the first intake valve flow rate that is calculated using the intake valve model equation, the aforementioned mechanical factors do not influence the second intake valve flow rate that is obtained based on the sensor value of the air flow sensor 16.

The sixth arithmetic unit 72 calculates an error included in the first intake valve flow rate that is obtained based on the intake valve model equation, by taking the second intake valve flow rate obtained based on the sensor value of the air flow sensor 16 as a standard. That is, the sixth arithmetic unit 72 calculates a difference between the first intake valve flow rate and the second intake valve flow rate as an intake valve flow rate error. The sixth arithmetic unit 72 executes learning of an intake valve flow rate error under at least four different operating conditions, and also specifies the coefficients $\alpha_1$, $\alpha_2$, $\alpha_3$ and $\alpha_4$ of each term of the intake valve flow rate error model equation based on the state quantities of the engine 10 under the operating conditions in which learning is performed, and stores the aforementioned coefficients $\alpha_1$, $\alpha_2$, $\alpha_3$ and $\alpha_4$ together with the learned values for the intake valve flow rate error. A coefficient map that is stored in the fourth arithmetic unit 68 is used for specifying the coefficients $\alpha_1$, $\alpha_2$, $\alpha_3$ and $\alpha_4$ under the learned operating conditions. Here, the term "operating condition" includes an operating region of the engine 10 that is defined based on the engine speed NE and a requested engine load that is calculated based on the accelerator opening degree.

A relation represented by the intake valve flow rate error model equation is established between learned values of the intake valve flow rate error, values of the coefficients $\alpha_1$, $\alpha_2$, $\alpha_3$ and $\alpha_4$ under the operating conditions in which learning is performed, and the four parameters (intake valve working angle deviation amount, exhaust valve working angle deviation amount, intake valve timing deviation amount and exhaust pressure loss deviation amount). This relation is established with respect to each learned value of n (n≥4) intake valve flow rate errors obtained by the sixth arithmetic unit 72, and these can be represented by the following equation (5) using a matrix. In this equation, for example, $\alpha_{31}$ means a value of the coefficient $\alpha_3$ that corresponds to a first learned value of the intake valve flow rate error, and $\alpha_{2n}$ means a value of the coefficient $\alpha_2$ that corresponds to an $n^{th}$ learned value of the intake valve flow rate error.

$$\begin{bmatrix} \text{Intake valve flow rate error learned value 1} \\ \text{Intake valve flow rate error learned value 2} \\ \vdots \\ \text{Intake valve flow rate error learned value } n \end{bmatrix} = \begin{bmatrix} \alpha_{11} & \alpha_{21} & \alpha_{31} & \alpha_{41} \\ \alpha_{12} & \alpha_{22} & \alpha_{32} & \alpha_{42} \\ \vdots & \vdots & \vdots & \vdots \\ \alpha_{1n} & \alpha_{2n} & \alpha_{3n} & \alpha_{4n} \end{bmatrix} \begin{bmatrix} \text{Intake valve working angle deviation amount} \\ \text{Exhaust valve working angle deviation amount} \\ \text{Intake valve timing deviation amount} \\ \text{Exhaust pressure loss deviation amount} \end{bmatrix} \quad \text{equation (5)}$$

The fifth arithmetic unit 70 is configured to calculate learned values of the four parameters using the above described equation. If a four-dimensional vector that adopts respective learned values of the four parameters as elements is taken as "z", an n-dimensional vector that adopts learned values of n (n≥4) intake valve flow rate errors as elements is taken as "y", and a matrix of n rows and 4 columns that adopts values of the respective coefficient $\alpha_1$, $\alpha_2$, $\alpha_3$ and $\alpha_4$ under a total of n operating conditions in which learning of intake valve flow rate errors is performed is taken as "X", equation (5) can be rewritten as shown in equation (6).

$$y = Xz \quad \text{equation (6)}$$

If equation (6) is solved using the least squares method with respect to the vector z, vector z can be represented by the following equation (7). Note that, $X^T$ in equation (7) is a transposed matrix of the matrix X. The fifth arithmetic unit 70 calculates respective learned value of the four parameters, that is, the intake valve working angle deviation amount, the exhaust valve working angle deviation amount, the intake valve timing deviation amount and the exhaust pressure loss deviation amount using equation (7).

$$z = (X^T X)^{-1} X^T y \quad \text{equation (7)}$$

Figure 4:
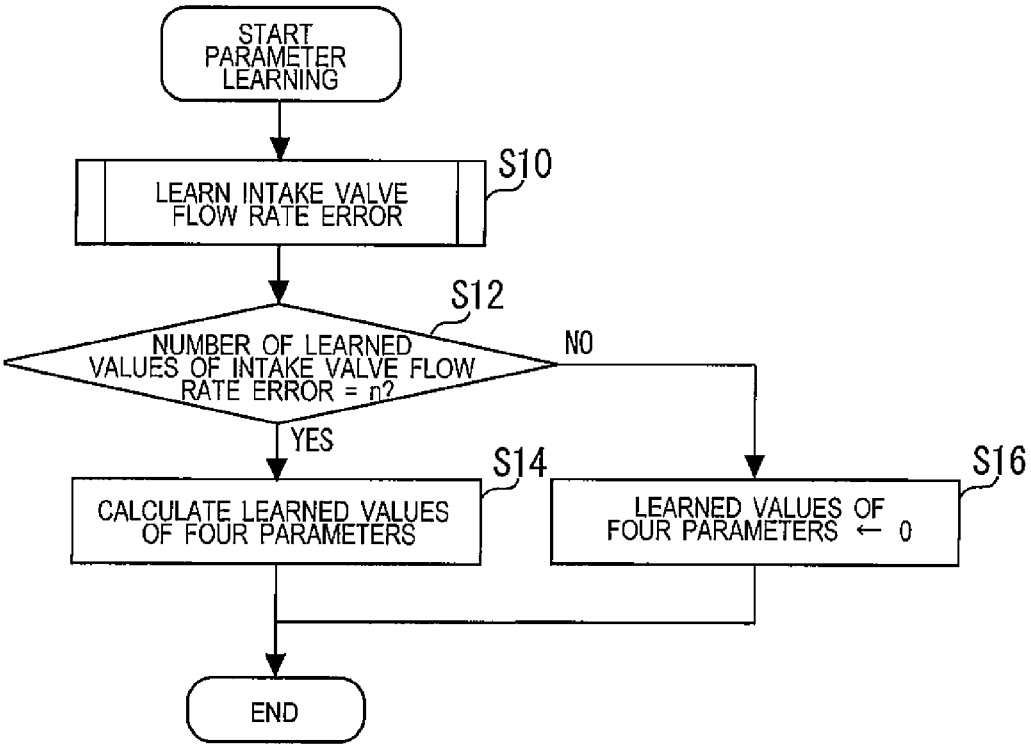
FIG. 4 is a flowchart illustrating a routine for parameter learning.

In the structure for estimating an intake valve flow rate that is described above, learning of the four parameters by the fifth arithmetic unit 70 and the sixth arithmetic unit 72 are incorporated into a routine illustrating a flow that is shown in FIG. 4. If learned values of the four parameters have not yet been calculated, the ECU 60 executes the routine shown by this flow each time an operating condition changes.

According to the flowchart shown in FIG. 4, first, in step S10, learning of an intake valve flow rate error is performed by the sixth arithmetic unit 72. The sixth arithmetic unit 72 corresponds to "error learning unit" that is described in the claims.

Next, in step S12, it is determined whether or not the number of learned values of the intake valve flow rate error that are learned by the fifth arithmetic unit 70 is a preset number n. The value of "n" is set to an integer of 4 or more.

If the number of learned values of the intake valve flow rate error is less than n, in step S16 the fifth arithmetic unit 70 sets the learned values of the four parameters to zero. If the number of learned values of the intake valve flow rate error reaches n, in step S14, the fifth arithmetic unit 70 calculates learned values of the four parameters based on the learned values of the intake valve flow rate error. The fifth arithmetic unit 70 corresponds to "parameter learned value calculating unit" described in the claims.

After the learned values of the four parameters are calculated, the ECU 60 executes the routine illustrated by the flowchart in FIG. 4 at intervals of a travelled distance or at intervals of an operating time period to update the learned values of the four parameters. The reason for updating is that changes arise in the values of the four parameters as deterioration of the components of the engine 10 proceeds.

Figure 5:
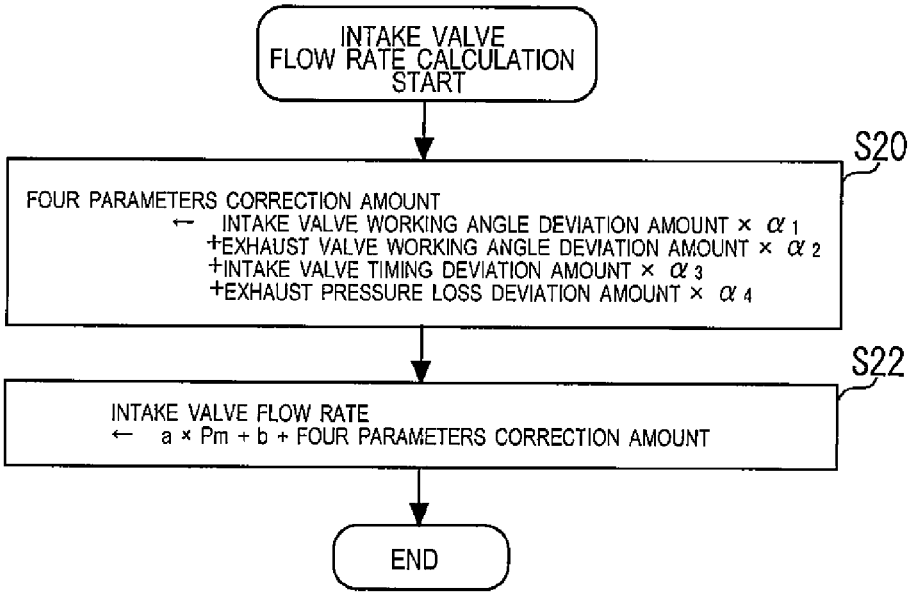
FIG. 5 is a flowchart illustrating a routine for calculating an intake valve flow rate.

Calculation of an intake valve flow rate by the first arithmetic unit 62, the second arithmetic unit 64, the third arithmetic unit 66 and the fourth arithmetic unit 68 is incorporated into a routine illustrated by the flowchart in FIG. 5. The ECU 60 repeatedly executes the routine illustrated by this flowchart at predetermined control periods that correspond to the clock speed of the CPU.

According to the flowchart illustrated in FIG. 5, first, in step S20, calculation of a four parameters correction amount is performed by the third arithmetic unit 66. The third arithmetic unit 66 receives learned values of the four parameters from the fifth arithmetic unit 70, and receives values of the coefficients $\alpha_1$, $\alpha_2$, $\alpha_3$ and $\alpha_4$ corresponding to the current operating conditions from the fourth arithmetic unit 68 and calculates the four parameters correction amount using the intake valve flow rate error model equation. If zero is set as the learned values of the four parameters, the value of the four parameters correction amount will also be zero.

"Correction amount calculating unit" described in the claims is constituted by the third arithmetic unit 66 and the fourth arithmetic unit 68.

Next, in step S22, the four parameters correction amount is added to the intake valve flow rate calculated by the intake valve model equation, and an intake valve flow rate that has been corrected using the four parameters correction amount is output. The coefficients $\alpha_1$, $\alpha_2$, $\alpha_3$ and $\alpha_4$ of the respective terms of the intake valve flow rate error model equation that are used for calculating the four parameters correction amount are functions of state quantities (engine speed, intake valve timing, exhaust valve timing, turbocharging pressure and intake pipe pressure) of the engine 10, and hence the values thereof are changed in accordance with the operating conditions. By this means, even under operating conditions other than operating conditions in which learning of an intake valve flow rate error is performed, for example, operating conditions for which the selection frequency is low, such as operating conditions that are only selected at a time of transition, since an appropriate four parameters correction amount that is in accordance with the operating conditions can be obtained, a decrease in the estimation accuracy of the intake valve flow rate can be suppressed under a wide range of operating conditions.

In this connection, learned values of the intake valve flow rate error that are learned under at least four different operating conditions are necessary for learning of the four parameters, and combinations of operating conditions exist that are preferable in terms of enhancing the learning accuracy with respect to the four parameters. A first to fourth operating condition that are four operating conditions which are described next are included in the aforementioned combinations.

Figure 6:
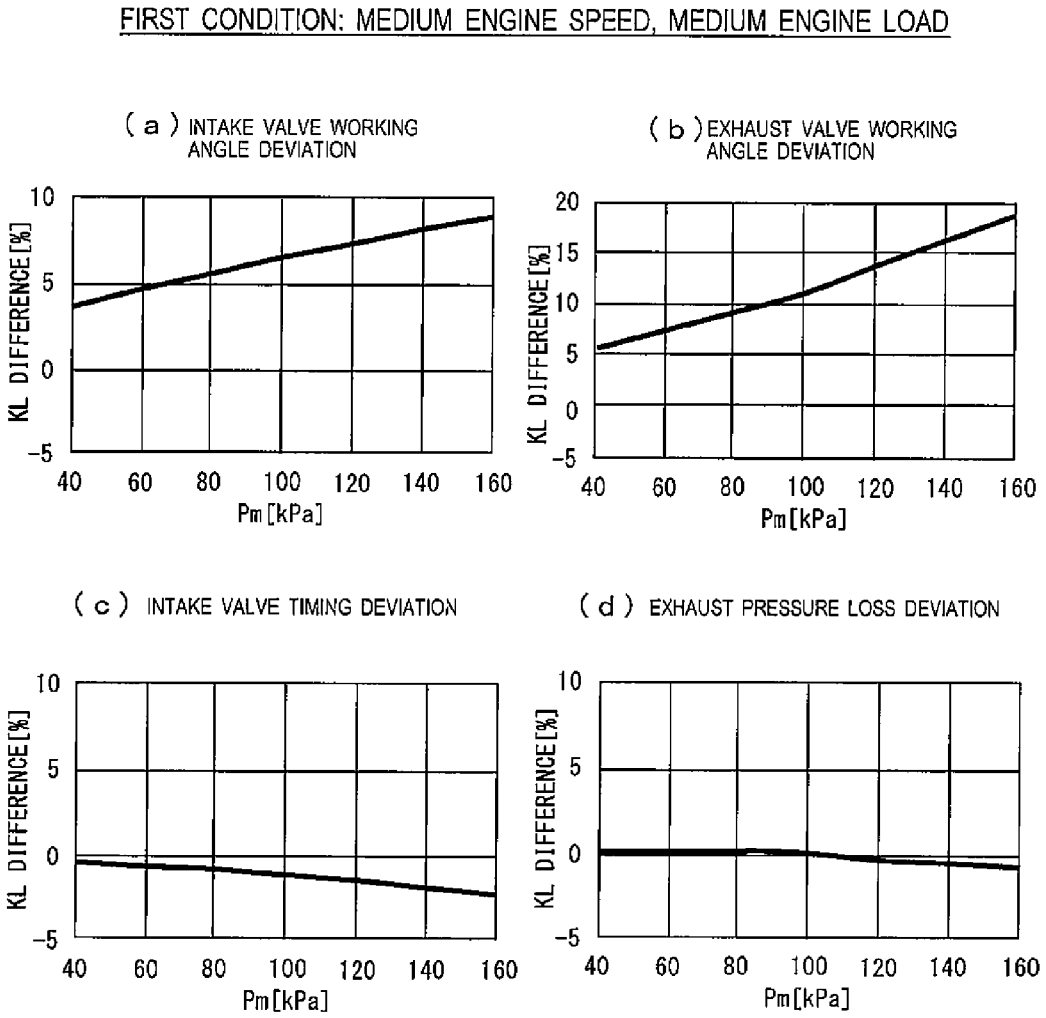
FIG. 6 is a chart group showing influences of the four parameters on an error of an in-cylinder air amount under a first condition.

The first operating condition is an operating condition under which steady-state running is being performed in a medium engine speed region and with a medium engine load. FIG. 6 is a chart group that illustrates the respective influences of the four parameters on an error of an in-cylinder air amount under the first operating condition. In FIG. 6, a change in an error (KL difference) of the in-cylinder air amount relative to the intake pipe pressure Pm is illustrated for each parameter. Based on FIG. 6 it is found that, under the first operating condition, an exhaust pressure loss deviation has almost no influence on the KL difference.

Figure 7:
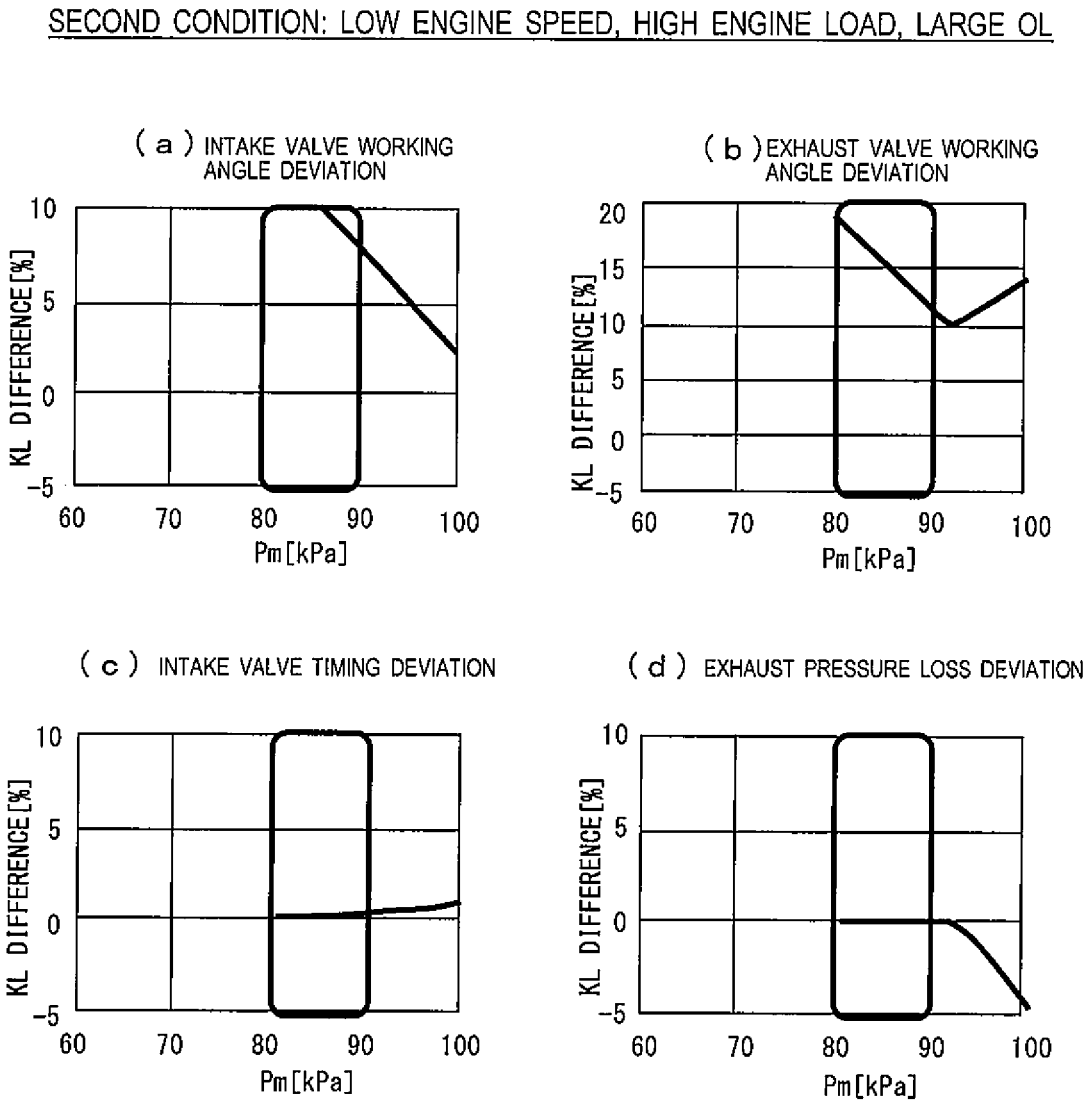
FIG. 7 is a chart group showing influences of the four parameters on an error of an in-cylinder air amount under a second condition.

The second operating condition is an operating condition at an early stage of acceleration (first half of turbo lag) under which the engine speed is lower and the engine load is higher than under the first operating condition, and an overlap between the intake valve 52 and the exhaust valve 54 is being expanded more than under the first operating condition. FIG. 7 is a chart group illustrating the influences of the four parameters on an error in the in-cylinder air amount under the second operating condition. In FIG. 7, changes in an error (KL difference) of the in-cylinder air amount with respect to the intake pipe pressure Pm are illustrated for each parameter. Based on FIG. 7 it is found that, according to the second operating condition, there is a region in which no influence is caused by an intake valve timing deviation and no influence is caused by an exhaust pressure loss deviation.

Figure 8:
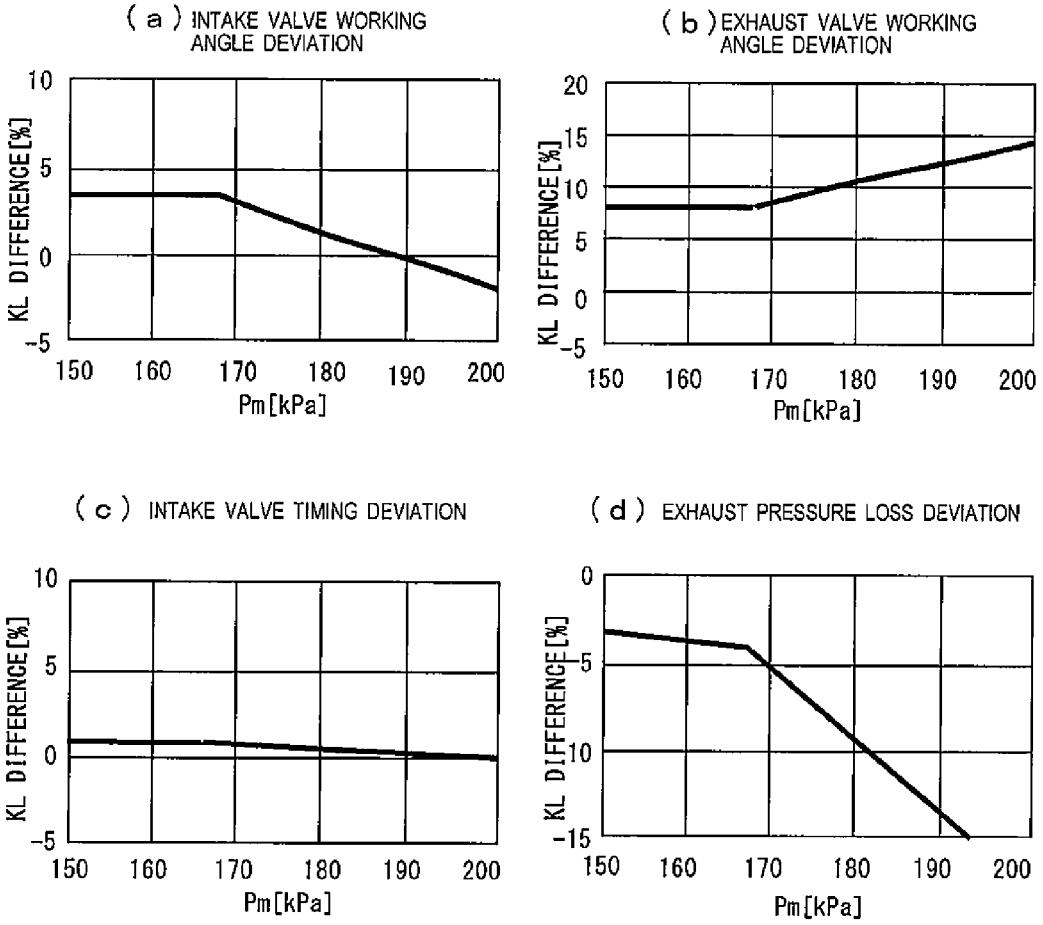
FIG. 8 is a chart group showing influences of the four parameters on an error of an in-cylinder air amount under a third condition.

The third operating condition is an operating condition at a middle stage of acceleration (latter half of turbo lag) under which the engine speed is higher than under the second operating condition and an overlap between the intake valve 52 and the exhaust valve 54 is being expanded in a similar manner to the second operating condition. FIG. 8 is a chart group illustrating the influences of the four parameters on an error of the in-cylinder air amount under the third operating condition. In FIG. 8, a change in the error (KL difference) of the in-cylinder air amount with respect to the intake pipe pressure Pm is shown for each parameter. Based on FIG. 8 it is found that, under the third operating condition, an intake valve timing deviation has almost no influence on an error of the in-cylinder air amount. Further, it is found that the tendency of the influence of the intake valve working angle deviation on the KL difference is different from the tendency of the influence of the exhaust valve working angle deviation on the KL difference.

Figure 9:
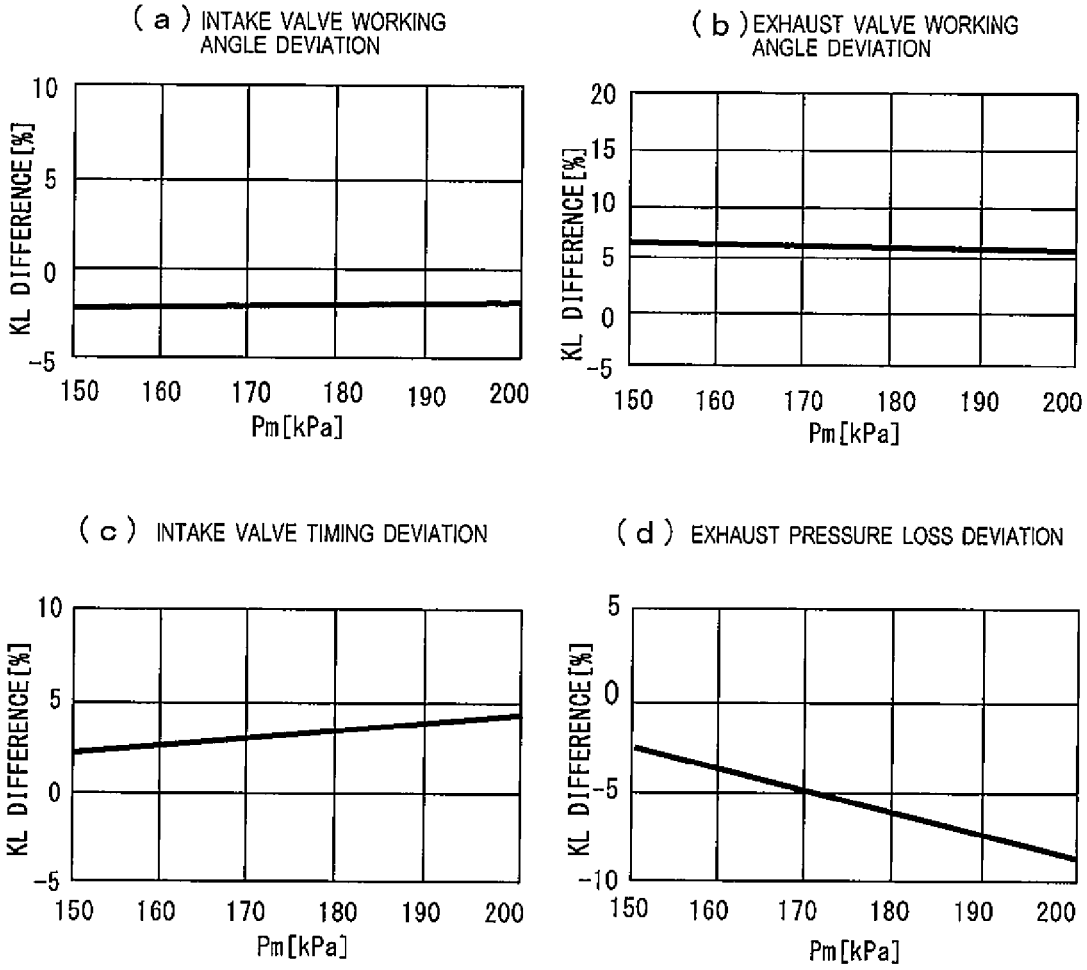
FIG. 9 is a chart group showing influences of the four parameters on an error of an in-cylinder air amount under a fourth condition.

The fourth operating condition is an operating condition at a final stage of acceleration (after turbo lag) under which the engine speed is higher than under the third operating condition, and an overlap between the intake valve 52 and the exhaust valve 54 is being contracted relative to the third operating condition. FIG. 9 is a chart group illustrating the influences of the four parameters on an error of the in-cylinder air amount under the fourth operating condition. In FIG. 9, a change in the error (KL difference) of the in-cylinder air amount with respect to the intake pipe pressure Pm is shown for each parameter. Based on FIG. 9 it is found that, under the fourth operating condition the tendency of the influence of the intake valve working angle deviation on the KL difference is different to the tendency of the influence of the exhaust valve working angle deviation on the KL difference.

Under these operating conditions, there are differences in the magnitudes of the influences of the four parameters on an intake valve flow rate error, and furthermore a parameter having a large influence differs for each operating condition. Therefore, by performing learning of the four parameters using intake valve flow rate errors that are learned under these operating conditions, errors included in the learned values of the respective parameters can be decreased and the learning accuracy can be enhanced.

Note that, although in the above described embodiment the control device according to the present disclosure is applied to a turbocharged engine that includes a turbocharger, an embodiment of the control device according to the present disclosure is also applicable to a supercharged engine that includes a mechanical supercharger or an electric supercharger. Further, an embodiment of the control device according to the present disclosure is also applicable to a naturally aspirated engine. Where an embodiment of the control device according to the present disclosure is applied to a naturally aspirated engine, it is good for the coefficients $\alpha_1$, $\alpha_2$, $\alpha_3$ and $\alpha_4$ of the respective terms in the intake valve flow rate error model equation to be functions of the engine speed, intake valve timing, exhaust valve timing and intake pipe pressure. Where the aforementioned engine is not equipped with an exhaust-side variable valve gear, it is good for the coefficients $\alpha_1$, $\alpha_2$, $\alpha_3$ and $\alpha_4$ to be functions of the engine speed, intake valve timing and intake pipe pressure. Where the engine is also not equipped with an intake-side variable valve gear, it is good for the coefficients $\alpha_1$, $\alpha_2$, $\alpha_3$ and $\alpha_4$ to be functions of the engine speed and intake pipe pressure.

The invention claimed is:

1. A control device for an internal combustion engine equipped with an air flow sensor and an intake pipe pressure sensor that is configured to estimate an intake valve flow rate based on an estimated value or a measured value of an intake pipe pressure using an intake valve model equation in which an intake valve flow rate is represented by a linear expression that adopts an intake pipe pressure as a variable, the control device comprising:

an error learning unit that is configured to learn, under at least four different operating conditions of the internal combustion engine, an intake valve flow rate error that is an error between a first intake valve flow rate obtained by inputting a measured value of an intake pipe pressure that is measured by the intake pipe pressure sensor into the intake valve model equation and a second intake valve flow rate that is calculated based on a measured value of a fresh air flow rate that is measured by the air flow sensor;

a parameter learned value calculating unit that is configured to use an intake valve flow rate error model equation in which the intake valve flow rate error is represented by a polynomial expression comprising a first order term of a first parameter that is an amount of deviation relative to a design value of an intake valve working angle, a first order term of a second parameter that is an amount of deviation relative to a design value of an exhaust valve working angle, a first order term of a third parameter that is an amount of deviation relative to a design value of an intake valve timing, and a first order term of a fourth parameter that is an amount of deviation relative to a design value of an exhaust pressure loss and in which coefficients of each term are taken as a function of state quantities of the internal combustion engine including at least an engine speed and an intake pipe pressure, to calculate respective learned values of the first parameter, the second parameter, the third parameter and the fourth parameter based on learned values of the intake valve flow rate error under at least four different operating conditions that are learned by the error learning unit and values of coefficients of the respective terms under the operating conditions under which learning of the intake valve flow rate error is performed; and a correction amount calculating unit that is configured to calculate using the intake valve flow rate error model equation a correction amount with respect to an intake valve flow rate that is calculated with the intake valve model equation, based on respective learned values of the first parameter, the second parameter, the third parameter and the fourth parameter that are calculated by the parameter learned value calculating unit.

2. The control device for an internal combustion engine according to claim 1, wherein:

the internal combustion engine is equipped with a turbocharger, an intake-side variable valve gear that makes a working angle and a valve timing of an intake valve variable, and an exhaust-side variable valve gear that makes a working angle and a valve timing of an exhaust valve variable, and the control device is configured to actuate the intake-side variable valve gear and the exhaust-side variable valve gear to expand an overlap between the intake valve and the exhaust valve during acceleration, and the parameter learned value calculating unit learns the intake valve flow rate error under at least a first operating condition in which steady-state running is being performed, a second operating condition that is an operating condition at an early stage of acceleration and under which an engine speed is lower and an engine load is higher than under the first operating condition, and the overlap is being expanded more than under the first operating condition, a third operating condition that is an operating condition at a middle stage of acceleration under which the engine speed is higher than under the second operating condition and the overlap is being expanded in a similar manner to the second operating condition, and a fourth operating condition that is an operating condition at a final stage of acceleration and under which the engine speed is higher than under the third operating condition and the overlap is being contracted relative to the third operating condition.

3. The control device for an internal combustion engine according to claim 1, further comprising a fuel injection valve actuation unit that is configured to calculate an in-cylinder air amount based on an intake valve flow rate that is calculated by the intake valve model equation and is corrected using the correction amount, and actuating a fuel injection valve in accordance with a fuel injection amount that is calculated based on the in-cylinder air amount.

* * * * *